US006250525B1

(12) United States Patent
Lehoux

(10) Patent No.: US 6,250,525 B1
(45) Date of Patent: Jun. 26, 2001

(54) HARNESS ATTACHMENT FOR A GUITAR

(76) Inventor: Randy A. Lehoux, 146 A Jaggar Rd., Sanford, ME (US) 04073

( * ) Notice: Subject to any disclaimer, the term of this patent is extended or adjusted under 35 U.S.C. 154(b) by 0 days.

(21) Appl. No.: 09/428,661

(22) Filed: Oct. 27, 1999

(51) Int. Cl.[7] ..... A45F 3/14

(52) U.S. Cl. ..... 224/257; 224/580; 224/910; 84/327; 984/257; 984/DIG. 1

(58) Field of Search ..... 224/257, 258, 224/259, 260, 262, 580, 608, 910; 84/327; 984/257, DIG. 1; D3/327; D17/20

(56) References Cited

U.S. PATENT DOCUMENTS

D. 306,871 * 3/1990 Bracy ..... D17/20
4,254,901 * 3/1981 McIntosh ..... 224/258
4,279,367 * 7/1981 Jacobs et al. ..... 224/257
4,930,695 * 6/1990 Thompson et al. ..... 224/257
5,069,103 * 12/1991 Healy ..... 84/327
5,291,816 * 3/1994 Adams ..... 84/327
5,596,158 * 1/1997 Tonon ..... 84/327

* cited by examiner

*Primary Examiner*—Stephen K. Cronin
(74) *Attorney, Agent, or Firm*—William F. Hamrock

(57) ABSTRACT

A harness attachment to shoulder strap harness for holding a guitar in the front of the player which is attached to the left fret end and right strumming end of the guitar. The present invention has an additional right srumming end attachment which mounts over the right strumming end attachment of the shoulder strap harness. The attachment of the present invention includes a lower mounting member and an upper adjustable loop member movably attachable to the player's right hip area in a number of embodiments.

20 Claims, 7 Drawing Sheets

HARNESS ATTACHMENT FOR A GUITAR

BACKGROUND OF THE INVENTION

The present invention relates to supporting and positioning a guitar or similar instrument, hereinafter referred to as a guitar, which is supported by a shoulder strap system by increasing the shoulder strap system support at the strumming end of the guitar and uniformly distributing the weight of the guitar over the player's shoulders and body.

The weight of a guitar is very heavy and uncomfortable to hold over long periods of time. Various suspension systems for supporting the guitar on the front of the body have been used. A type of suspension strap commonly used is a single strap slung over one shoulder. However the strap rests on very sensitive muscles close to the player's neck. Within a short period of time, the player develops fatigue and discomfort. Other types offer double strap type solutions which attempt to split the weight in half and attempt to evenly distribute the weight across the shoulders or affixed to a belt but the result is that it appears to make the suspension system rigid, uncomfortable and less appropriate for guitar use. Applicant has recently developed a Double Strap Harness for a Guitar, U.S. patent application Ser. No. 09/363,812, filed Jul. 30, 1999 that overcomes the defeciencies of these prior shoulder strap systems. The present invention is directed improving the effeciencies of these prior shoulder strap systems when they are being used.

SUMMARY OF THE INVENTION

The present inventions overcomes the deficiencies of the prior art single and double shoulder strap systems which are attached to the protruding mounting buttons or other attachable means at the guitar's right end or strumming end and the left end or fret end, hereinafter referred to as the right end or left end of the guitar. This is accomplished with the present unique additional right end mounting attachment which is attached to the guitar's right end mounting button means extending over the prior art right end attached shoulder element attached to the button.

The present harness system encompasses a resilient, flexible lower member, preferably a slit fabric or leather tongue sleeve, movably attached to the bottom bar of a connecting bracket, and an upper adjustable strap loop member, preferably a sturdy, resilient fabric strap or similar item, slidably attached to the top bar of the connecting bracket. The slit tongue sleeve fits over the attached shoulder strap right end element and is itself attached to the protruding guitar right end button. The upper loop member is slidably attached to the clothing or waiste belt of the player by various means and hangs down adjacent the player's right hip area.

By combining the present harness right end mounting system with the prior art shoulder strap systems, the player is able to uniformly distribute the weight of the guitar away from sensitive shoulder muscles to more comfortable positions. By being able to set the guitar's right end a little higher off the right hip due to the adjustable loop, this tends to push the guitar's weight of the right end to the tongue sleeve which removes the weight off the left shouder for a single shoulder strap, or off of both shouders for a double shoulder strap system. The player is thus able to adjust the guitar to the most comfortable position not previously available.

DETAILED DESCRIPTION OF THE PREFERRED EMBODIMENT

Figure 1:
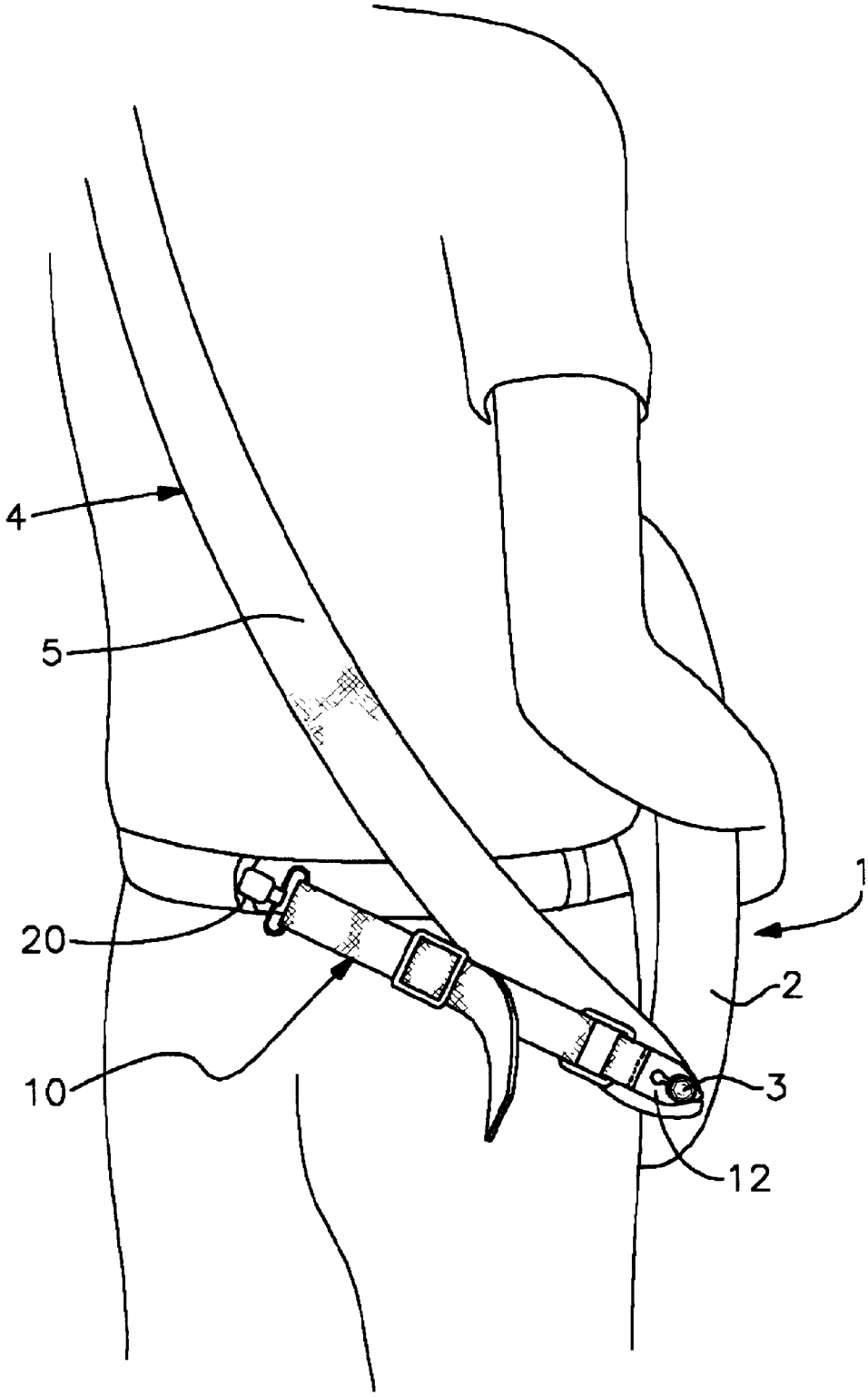
FIG. 1 is a view of a player wearing the harness of the invention supporting a guitar.

FIG. 1 illustrates a player wearing a harness attchment 10 of the invention supporting a guitar 1 at the front of the player's body. Shown are the protruding right end or strumming end 2 of the guitar and the strummung end button 3 for mounting the guitar to the prior art shoulder straps harnesses. Shown also is a known shoulder strap system 4 representing prior art shoulder strap systems that are used with guitars and the type of shoulder strap system which can be used with the present harness attachment of this invention. Each of the guitar buttons has an enlarged head or other type of mounting means over which the prior art right end strap 5 and left end strap not shown are mounted.

Figure 2A:
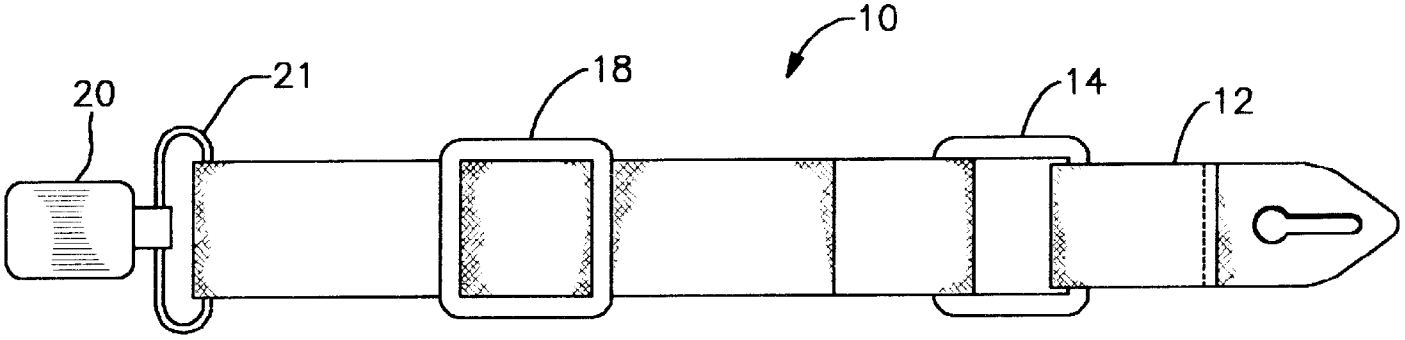
FIGS. 2A and B are top and side views of one embodiment of the harness of the invention with a suspender clip.
Figure 2B:
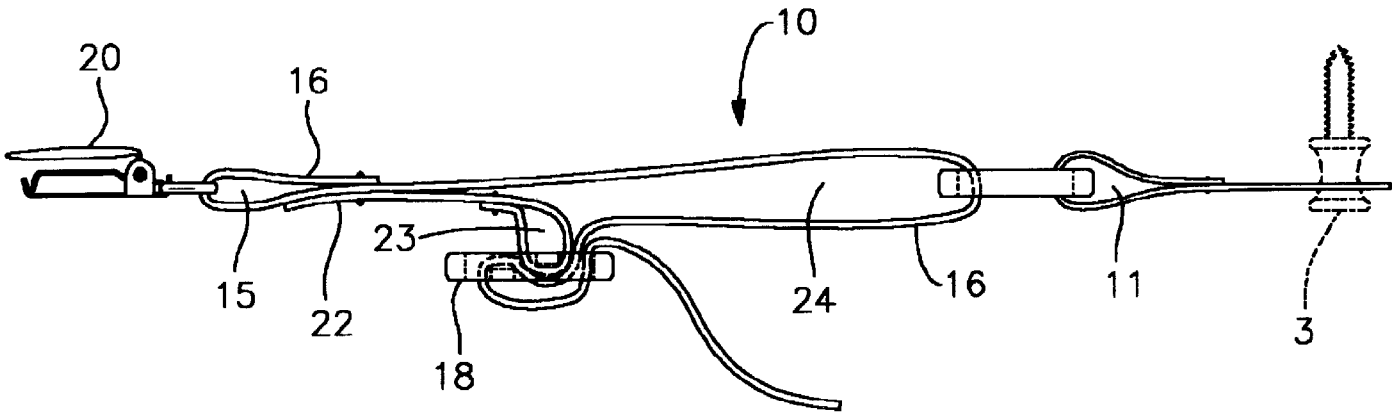
Figure 3:
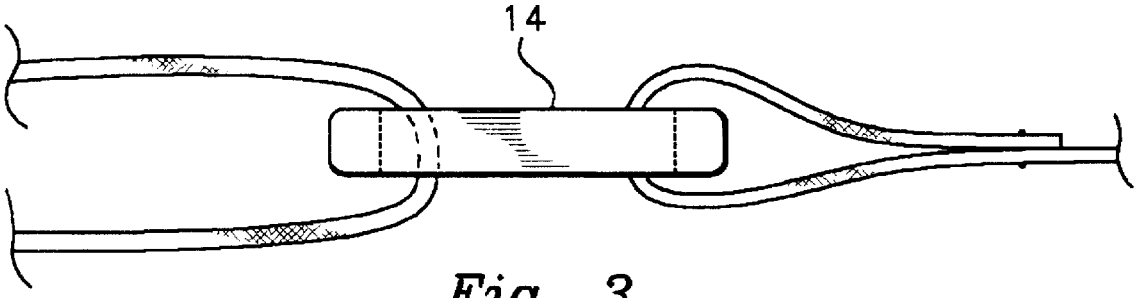
FIG. 3 is a detailed view of a connector bracket.
Figure 4:
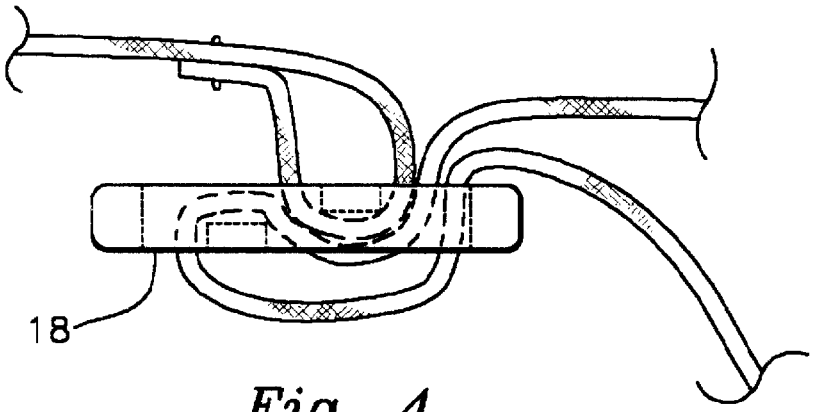
FIG. 4 is a detailed view of a strap adjuster.
Figure 5:
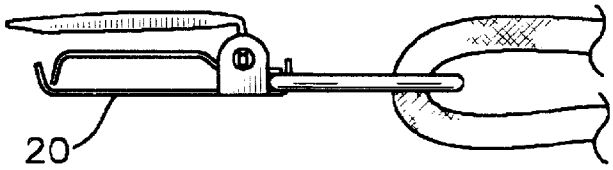
FIG. 5 is a detailed view of a suspender clip.

Shown in FIGS. 2A and B are overall isolated top and side views of harness attachment 10 featuring one embodiment of the present invention and is the embodiment illustrated in FIG. 1 attached to the right end strummung button 3 extending over the right end strap 5 of the shoulder strap. Harness attachment 10 as seen in the drawings includes a resilient slit fabric or leather tongue sleeve 12 movably mounted on the bottom bar of connecting bracket 14 by sewing to itself or other means. Tongue sleeve 12 fits over the guitar's right end button 3 in securing harness attachment 10 to the guitar. An adjustable strap loop member 16 made of resilient durable fabric or similar material is slidably looped through the top bar of connecting bracket 14. One end of loop member 16 is adjustably mounted through triple bar strap adjuster 18 and the opposite end is slidably mounted on bar 21 of suspender clip 20 by sewing to itself or other means. Short strap 22 movably attaches strap adjuster 18 to loop member 16 by being movably mounted at one end to the middle bar of strap adjuster 18 by sewing to itself or other means and is secured to loop member 16 by sewing to the loop member at the suspender clip bar 21 thereby forming loop 24.

Each of the above three connections: of the tongue sleeve 12 to connecting bracket 14; of one end of loop member 16 to suspender clip bar 21; and of short strap 22 to strap adjuster 18 are movably mounted by small connecting loops 11, 15 and 23 formed at their connections on the bars of the devices. One of the benefits of these amall loop connections and of long loop 24 is that it allows the uniform distribution of the weight of the right end of the guitar to be distributed away from the sesitive shoulder muscles and placed on a more comfortable body position on the when the guitar is moved about. For example, when the tongue 12 is set higher off the right hip, this tends to push the weight of the right end of the guitar to the tongue which in turn removes the shoulder strap weight off of the left shoulder for single shoulder strap systems and off of both shoulders for double shoulder strap systems.

As seen in FIG. 1, harness attachment 10 hangs loosely off the right hip, generally tongue 12 is about six to eight inches off the hip. Suspender clip 20 is seen clipped on to the player's pants. However, there are no limitations as to where the suspender clip can be attached for instance to other areas of the player's clothing or to a waiste belt or other belt.

A preferred connector bracket 14 is shown in FIGS. 2A and B and 3. Generally, it is the double bar rectangular bracket, such as a dee, but also can be a multibar bracket or ring or similar device which movably attaches items at each end of the bracket. A preferred strap adjuster 18 is shown in FIGS. 2A and B and 4. Generally, it is the triple bar rectangular strap adjuster allowing one end of the strap to be adjustably mounted for lenght through the bars and the opposite end of the same strap or another strap to be movably attached to the center bar by sewing to itself or other means. A preferred suspender clip 20 is shown in FIGS. 2A and B and 5 which is a typical suspender clip generally secured to a double bar bracket 21.

Figure 6:
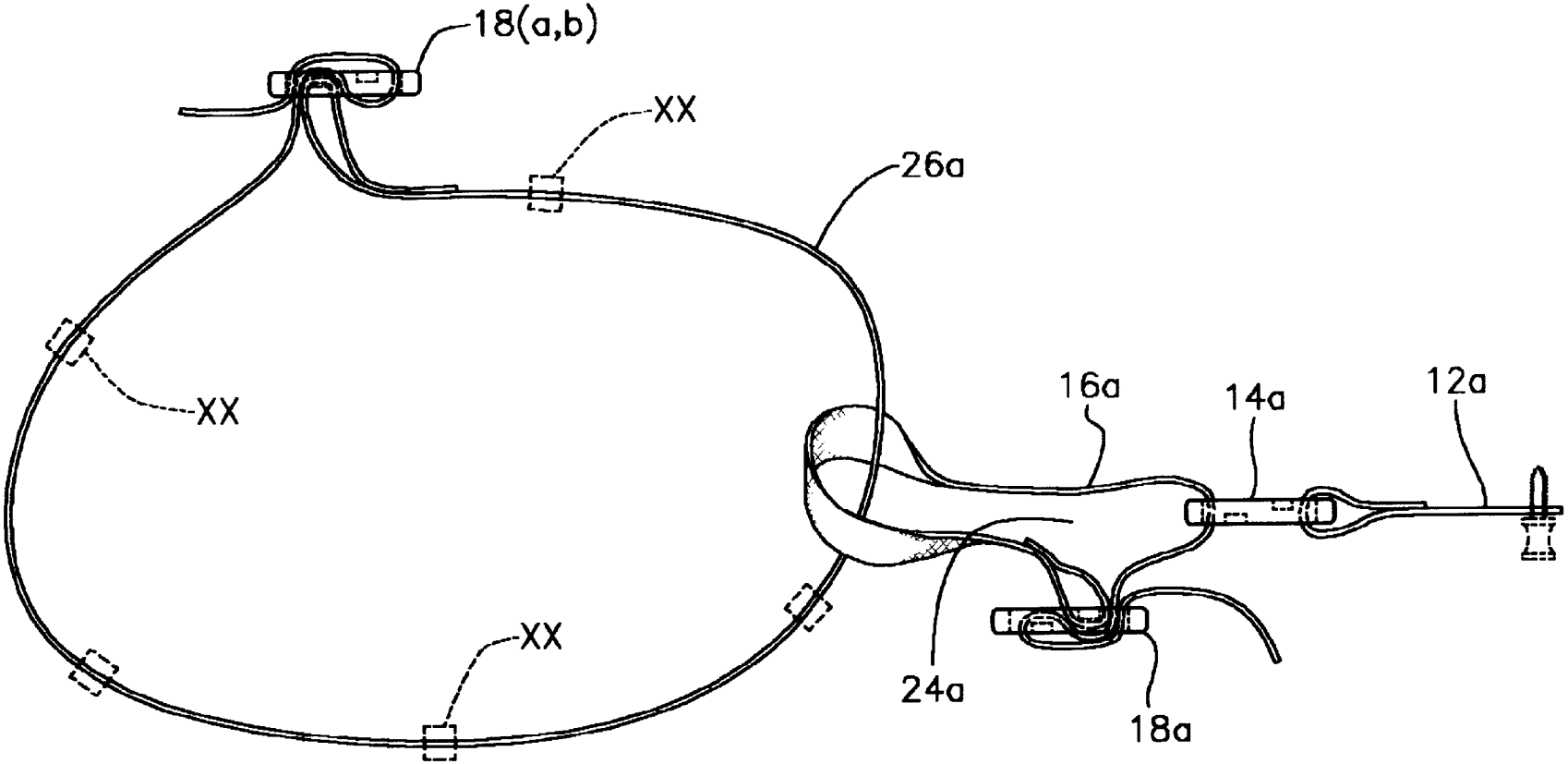
FIG. 6 is a view of another embodiment of the harness attached to a waiste belt.

Shown in FIG. 6 is a preferred embodiment of the invention in which the adjustable loop member 16(*a*) is slidingly attached to the waiste belt 26(*a*). One end of adjustable loop member 16(*a*) is adjustably attached through strap adjuster 18(*a*) and is movably attached at its opposite end to the middle bar of the strap adjuster by sewing to itself or other means. Connecting bracket 14(*a*) is movably attached to loop member 16(*a*) at the lowest point of loop 24(*a*). Waiste belt 26(*a*) is shown adjustably attached to belt strap adjuster 18(*ab*) through belt loops xx.

There are several advantages provided by this embodiment which includes the waiste belt. In particular, the combined movably mounting connections of the upper portion of loop 24(*a*) being movably mounted on waiste belt 26(*a*), and connecting bracket 14(*a*) being movably mounted at the lowest point in loop 24(*a*) and slit tongue 12(*a*) being movably mounted on connecting bracket 14(*a*), not only increase the freedom of movement of the guitar but also reduce the weight of the guitar on sensitive muscles which has not been previously obtainable with prior shoulder strap harnesses.

Figure 7:
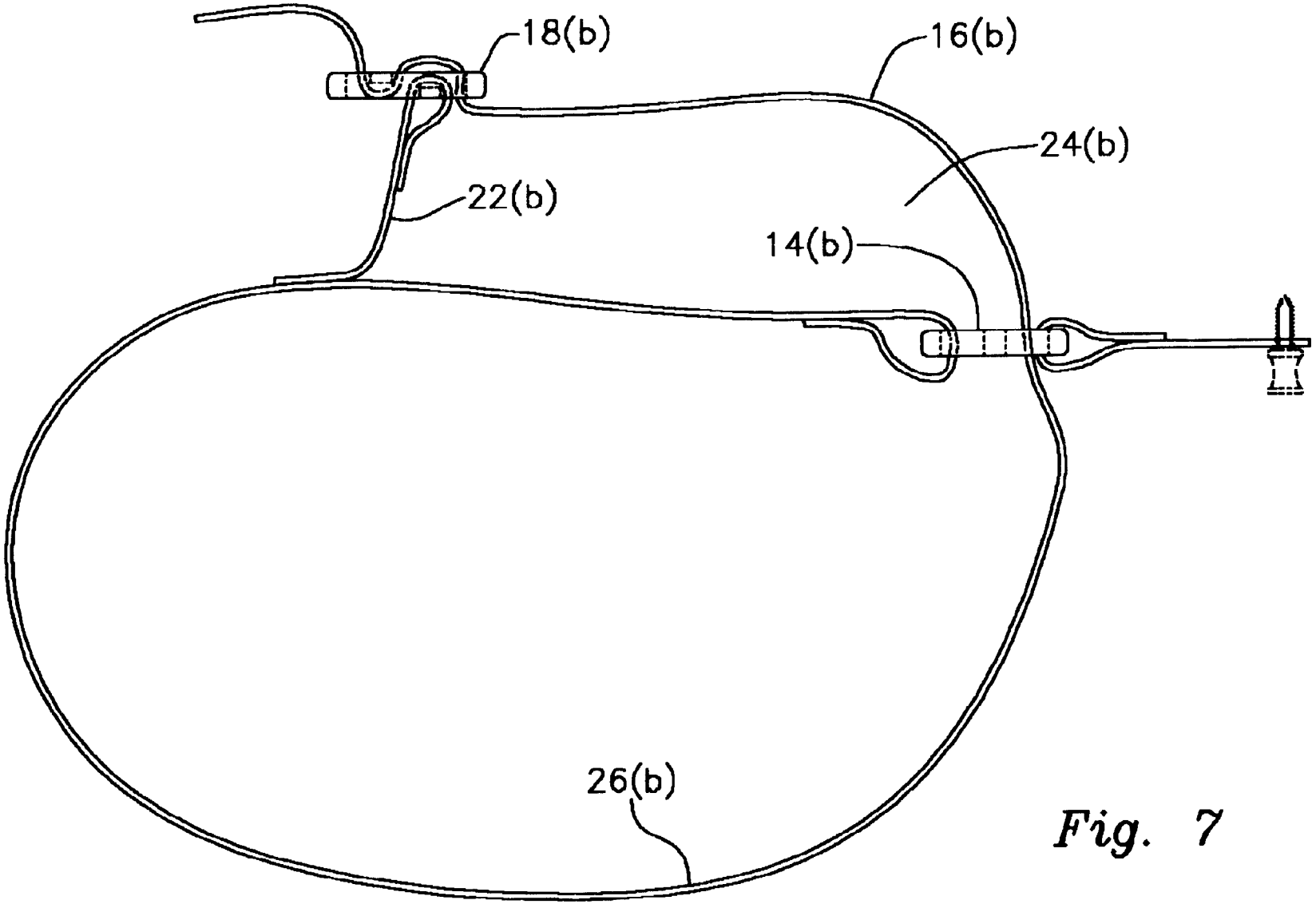
FIG. 7 is a view of a further embodiment of the harness with a contiguous loop.

FIG. 7 depicts the preferred contigious waist belt embodiment of the invention in which the adjustable loop member 16(*b*) is formed from the contingious extension of waiste belt 26(*b*) forming contigious loop 24(*b*). In this embodiment, the front end of waiste belt 26(*b*) is movably attached to the top bar of triple bar bracket 14(*b*) by sewing to itself or other means. The opposite end of the of the waiste belt encircles the waiste and then passes through the center bar of bracket 14(*b*) forming adjustable loop member 16(*b*) which overlaps the front end of the waiste belt extending from the top bar of bracket 14(*b*) providing a double strap support at the right strumming end of the guitar. The opposite end of the adjustable loop-member is adjustably mounted through strap adjuster 18(*b*) which is movably mounted to the front end of the waiste belt by short strap 22(*b*). Slit tongue 12(*b*) is movably supported on the bottom bar of supporting bracket 14(*b*).

In this contiguous waiste belt embodiment, contiguous loop 24(*b*) is formed from the front section of waiste belt and adjustable loop member 16(*b*) which overlaps the front end of the waiste belt forming a double strap loop support. Another double support for an element is also provided for triple bar connecting bracket 14(*b*) wherein the top and middle bars are movably supported by waiste belt 26(*b*). Thus, in addition to the other benefits provided by the harness attachment of the invention, the increased support of loop 24(*b*) and connector bracket 14(*b*) allows for greater movement and conformable positioning of the guitar.

Figure 8:
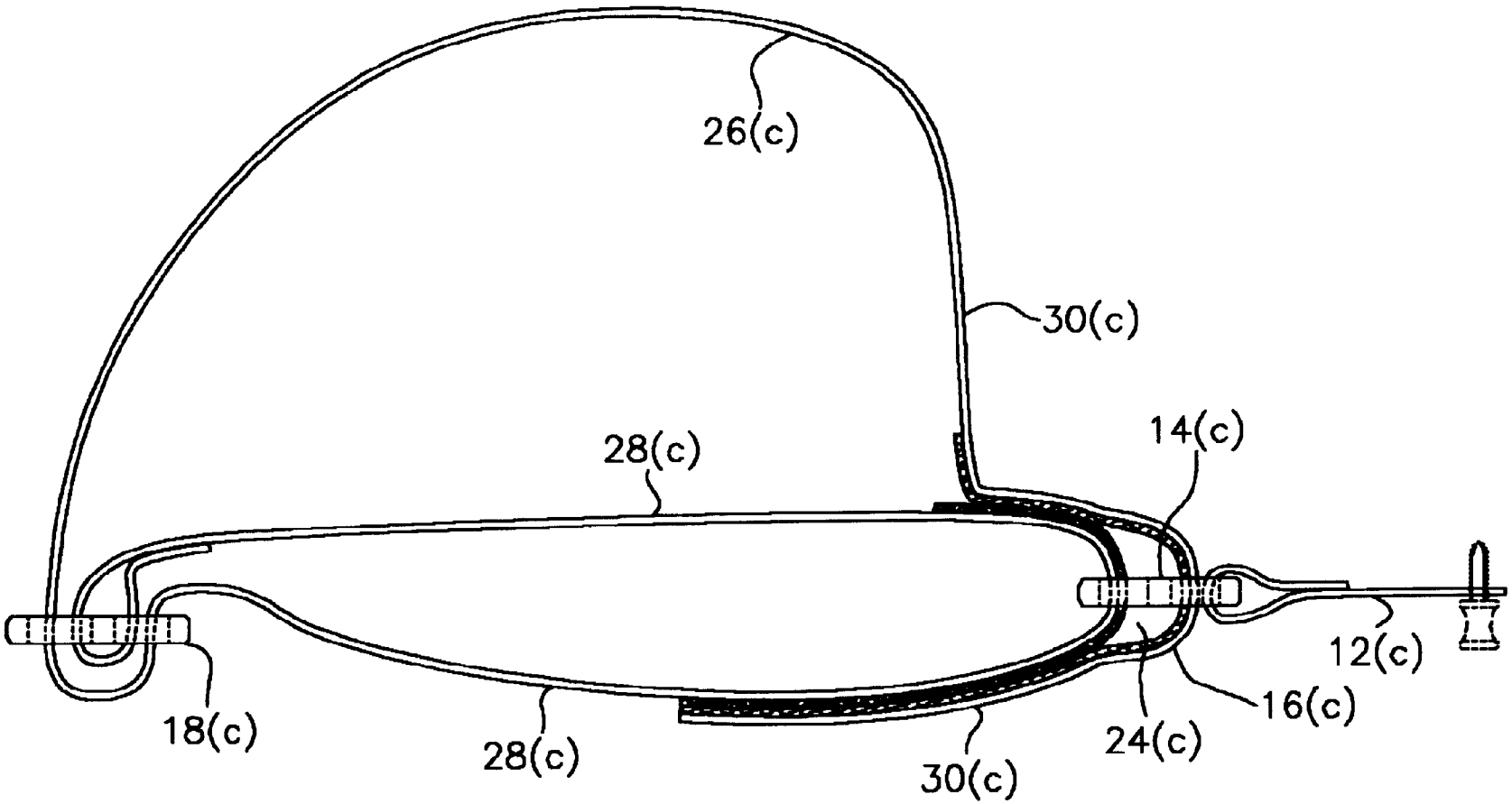
FIG. 8 is a view of an embodiment of the harness with a surface engaging contiguous loop.

Shown in FIG. 8 is the preferred embodiment of the invention in which the adjustable loop member 16(*c*) is formed from the contigous extension of waiste belt 26(*c*), having front end 28(*c*) and back end 30(*c*), forming surface engaging contiguous loop 24(*c*). The description of this embodiment is more clearly defined in reverse order starting with the front end 28(*c*) of loop member 16(*c*).

The front end 28(*c*) is movably attached to the middle bar of strap adjuster 18(*c*) by sewing to itself or other means. The front end extends outwardly and loops under the top bar of triple bar bracket 14(*c*) initiating the formation of the area where loop 24(*c*) is to be formed. Front end 28(*c*) extends back through strap adjuster 18(*c*) at which time waiste belt 26(*c*) is formed. The extension of the front end through the strap adjuster forms the contiguous extension of back end 30(*c*) which overlaps, and is releasably adhesively secured to, the mating surtfaces of the front end 28(*c*) preferably by Velcro. Back end 30(*c*) loops under the middle bar of bracket 14(*c*) extending therethrough in releasble contact with front end 28(*c*) forming surface engaging contiguous loop member 16(*c*) and contiguous loop 24(*c*). The size of loop 24(*c*) is controlled by adjusting the overlapping adhesively engaging surfaces to the desired configuration having Velcro or similar adhesive material thereon. Slit tongue 12(*c*) is movably supported on the bottom bar of bracket 14(*c*).

In this surface engaging adjustable loop embodiment, surface engaging contiguous loop member 16(*c*) and loop 24(*c*) are formed by the back end 30(*c*) of waiste belt 26(*c*) overlapping and being secured to the surface of front end 28(*c*), overlapping the middle bar of strap connector 14(*c*) and onto the engaging surface of the opposite end of front end 28(*c*). In addition to the other benefits provided by the harness attachment of this invention, the enormous support of the doubly engaged surfaces of loop member 16(*c*), of the encased movably mounted middle bar of bracket 14(*c*), and of the overlapped and secured front and back ends of the waiste belt 26(*c*) allows for the greatest movement and most comfortable positioning of the guitar previously unobtainable with shoulder strap systems.

Figure 9:
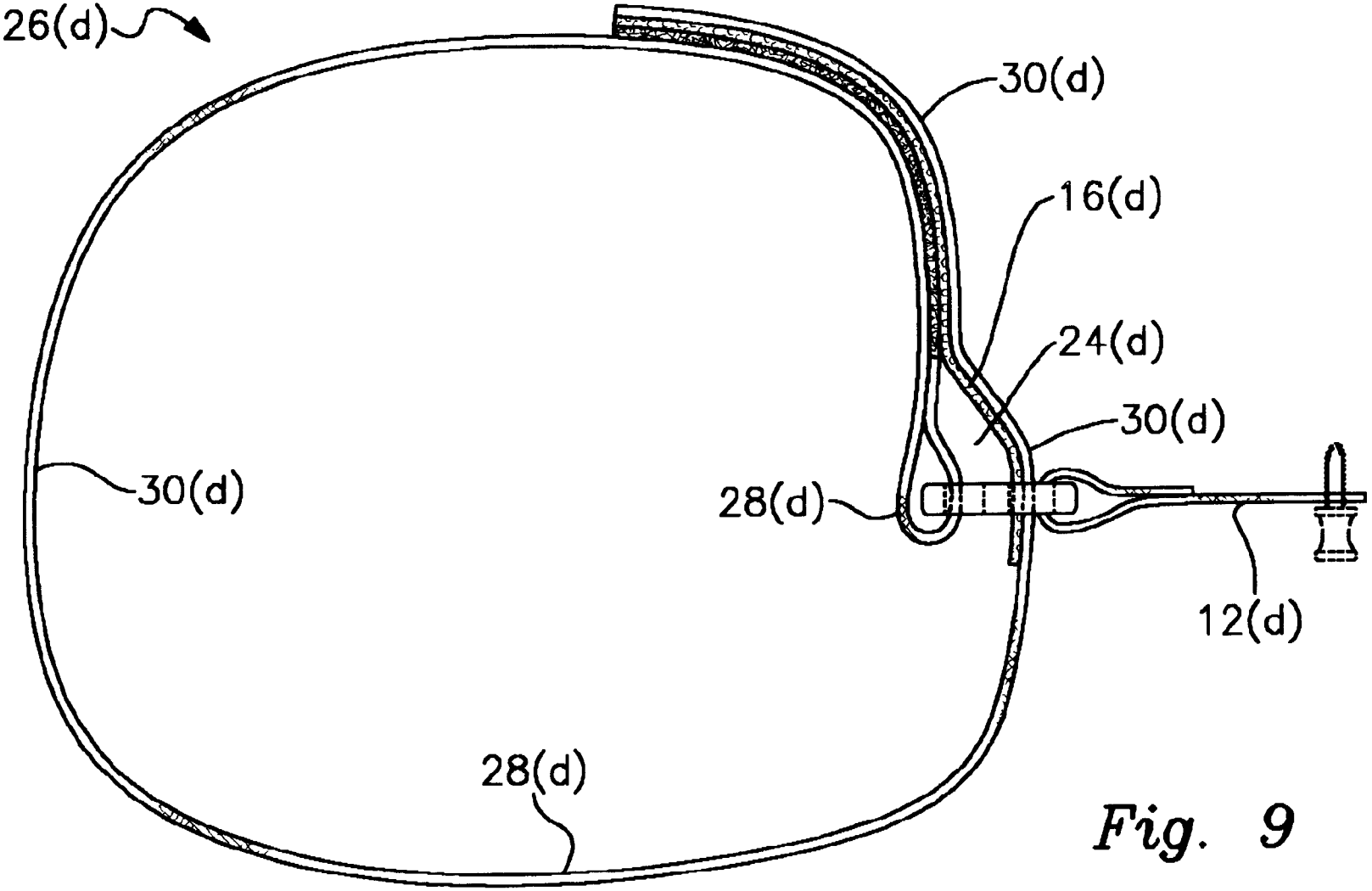
FIG. 9 is a view of an embodiment of the harness with a strap adjustable surface engaging strap adjustable contiguous loop.

Shown in FIG. 9 is a modification of the surface engaging waiste belt 26(*d*). In this embodiment the strap adjuster 18(*c*) of FIG. 8 is eleminated and the strap adjustments are made by front end 28(*d*) and back end 30(*d*) waiste belt engaging surfaces.

Front end 28(*d*) is movably attached to the top bar of triple bar bracket 14(*d*) by sewing to itself or other means. The front end extends outwardly around the waiste forming waiste belt 26(*d*) and forms the contiguous extension back end 30(*d*) which loops under the center bar of bracket 14(*d*) forming the contiguous loop member 16(*d*) and contiguous loop 24(*d*). The back end overlaps, and is releasably secured to, the mating top surface of front end 28(*d*) preferably by Velcro or equivalent adhesive means forming surface engaging contiguous loop 24(*d*). The length and size of loop member 16(*d*) and loop 24(*d*) and of waiste belt 26(*d*) are controlled by adjusting the overlapping adhesively engaging surfaces to the desired configuration. Slit tongue 12(*d*) is movably supported on the bottom bar of bracket 14(*d*).

In this modified surface engaging adjustable loop embodiment, surface engaging contiguous loop member 16(*d*) and loop 24(*d*) are formed by the back end 30(*d*) overlapping and being secured to the upper surface of front end 28(*d*) and being adjustably sized by manipulating the engaging surfaces. In this embodiment also, the increased support of front end 28 and back end 30(*d*) around the top and middle bars of bracket 14(*d*) and of the overlapped and secured front and back ends of waiste belt 26(*d*) allow for the greatest movement and most comfortable positioning of the guitar previously unobtainable with shoulder strap systems.

While the present invention has been described and illustrated with respect to the preferred embodiment, it will be appreciated that variations of the invention may be made without departing from the scope of the invention which is defined in the appending claims.

What is claimed is:

1. A harness for supporting and positioning a guitar in front of a player, said guitar having mounting means at right and left ends thereof, and a shoulder strap system extending over at least one shoulder and having attachments attachable to the left and right end mounting means of the guitar, comprising an additional right end mounting attachment attachable to the right end mounting means of the guitar, said additional right end mounting attachment, comprising a lower mounting member movably mountable on the guitar's right end mounting means extending over the shoulder strap system right end mounting means attachment thereon and an upper adjustable loop member slidably attachable to the player adjacent to the right hip area of the player.

2. A harness according to claim 1 wherein the lower mounting member comprises a resilient flexible element movably mounted on a bottom bar of a connecting bracket comprising a bottom bar and a top bar.

3. The harness according to claim 2 wherein the resilient flexible element comprises a slit tongue sleeve.

4. The harness according to claim 2 wherein the upper adjustable loop member is slidably mounted on the connecting bracket.

5. The harness according to claim 4 wherein an upper adjustable contiguous loop is formed from surface engaging overlapping loop members of a waiste belt's front end and oppoite end extensions passing through said connecting bracket.

6. The harness according to claim 5 wherein the overlapped surface engaging waiste belt adjusts the length of the contiguous loop members and contiguous loop.

7. The harness according to claim 6 wherein said waiste belts front end extension is movably mounted on the top bar of the connecting bracket and its opposite end passes through a center bar forming the contiguous loop and then engages the overlapped waiste belt.

8. The harness according to claim 4 wherein the upper adjustable loop member is adjustably mounted through a multibar strap adjuster.

9. The harness according to claim 8 wherein the upper adjustable loop member is slidably attachable to a suspender means mountable on the player.

10. The harness according to claim 9 wherein a waiste belt is mounted on the player and the suspender means is movably mountable on the waiste belt.

11. The harness according to claim 10 wherein the suspender means comprises a suspender clip device.

12. The harness according to claim 8 wherein the upper adjustable loop member is a resilient durable fabric loop member.

13. The harness according to claim 12 wherein the upper adjustable loop member is slidably mounted on a waiste belt mountable on the player.

14. The harness according to claim 13 wherein the upper adjustable loop member is a contiguous loop member extension of the waiste belt having a front end and an opposite end, said front end slidably mounted on the top bar of a triple bar connecting bracket.

15. The harness according to claim 14 wherein the opposite end of the contiguous waiste belt passes through a middle bar of the connecting bracket forming the contiguous loop member overlapping the front end of the waiste belt.

16. The harness according to claim 15 wherein the contiguous loop member is adjustably mounted through a multibar contiguous strap adjuster.

17. The harness according to claim 16 wherein the contiguous strap adjuster is movably mounted to the contiguous waiste belt.

18. The harness according to claim 13 wherein an upper adjustable loop is formed from surface engaging intermediary loop members of the overlapped surface engaging waiste belt's front end and opposite end extensions passing through the connecting bracket.

19. The harness according to claim 18 wherein said waiste belt front end extends from a strap adjuster and back through the strap adjuster.

20. A harness according to claim 19 wherein said contiguous loop members pass through the connecting bracket and are releasably engaged and adjustably mounted thereon.

* * * * *